US005506561A

United States Patent [19]

Heritier-Best

[11] Patent Number: 5,506,561

[45] Date of Patent: Apr. 9, 1996

[54] IGNITION COIL

[75] Inventor: Pierre Heritier-Best, Orbeil, France

[73] Assignee: Sagem Allumage, France

[21] Appl. No.: 438,620

[22] Filed: May 10, 1995

[30] Foreign Application Priority Data

May 10, 1994 [FR] France ..... 94 05734

[51] Int. Cl.[6] ..... H01F 15/10; H01F 27/30

[52] U.S. Cl. ..... 336/185; 336/192; 336/198

[58] Field of Search ..... 336/185, 192, 336/198, 208, 180, 182

[56] References Cited

U.S. PATENT DOCUMENTS 1,960,033 5/1934 Smith ..... 336/185
2,478,087 8/1949 Bychinsky et al. .
3,843,946 10/1974 Anderson et al. ..... 336/198

FOREIGN PATENT DOCUMENTS 0071172 2/1983 European Pat. Off. .
1113514 12/1955 France .
1290274 3/1962 France .

*Primary Examiner*—Thomas J. Kozma
*Attorney, Agent, or Firm*—Rosenman & Colin

[57] ABSTRACT

An ignition coil comprising a magnetic core and primary and secondary windings wound around the magnetic core is disclosed. At least the secondary winding is wound on a tubular secondary bobbin and the primary winding is disposed within the secondary bobbin.

In accordance with the invention, the secondary bobbin is closed on the side of the high voltage terminal end of the secondary winding.

2 Claims, 2 Drawing Sheets

IGNITION COIL

BACKGROUND OF THE INVENTION

1. Field of the Invention

The present invention relates to an ignition coil and, more particularly, to an ignition coil which has a magnetic core and primary and secondary windings wound around the magnetic core, at least the secondary winding being wound on a tubular secondary bobbin and the primary winding being arranged in the secondary bobbin.

2. Discussion of Related Art

Such ignition coils are well known in the field of internal combustion engines. When a low voltage is applied and then removed at the terminals of the primary winding, this results in a high voltage pulse at the terminals of the secondary winding. This pulse is applied to an ignition coil of the engine, which causes the explosion of the gases contained in the corresponding cylinder.

Generally, the primary winding is itself wound on a primary bobbin arranged within and coaxial to the second bobbin. However, it is also possible to wind the primary winding directly on the magnetic core.

In the case of an ignition coil of the so-called single terminal type, one of the ends of the secondary winding is connected to ground, that is to say, in practice to one of the ends of the primary winding, and the other end of this secondary winding which constitutes the high voltage terminal is connected to the spark plug. A difficulty arises on the part of the coil where this high voltage terminal is located. In fact, at the time of the pulse it is brought to a voltage which is several tens of a kilovolt with respect to the ground and, in fact, with respect to the entire primary winding since only a low voltage is present at the terminals of the latter. Accordingly, there are important risks of disruptive breakdown between the high voltage terminal and the primary winding.

In EP-A-0 071 172, a secondary bobbin is proposed which is closed on the side of the high voltage terminal end of the secondary winding.

In that document the secondary bobbin is in the form of a tube provided with a bottom on the side of the end of the secondary winding forming the high voltage terminal. This bobbin can be made of a plastic material of high dielectric strength, making the forming of an arc between the high voltage terminal and the primary winding impossible.

So-called double terminal coils are also known. In such coils, each of the two ends of the secondary winding is connected to a spark plug. The high voltage pulse is formed at the time that the cylinder corresponding to one of the spark plugs contains the mixture to be exploded and the cylinder corresponding to the other spark plug contains burned gases. Due to the differences in electric properties between the combustible mixture and the burned gases, a single spark of high energy is formed on the side of the combustible mixture, the other spark, or lower energy, serving only as ground return.

The problem of disruptive breakdown at the place of the high voltage terminal arises therefore differently in the case of a double terminal spark plug. In fact, with an arrangement such as that which has just been described, one of the high voltage terminals would be effectively insulated from the primary winding by the bottom of the secondary bobbin, but this would not be true of the side of the other high voltage terminal, where disruptive breakdowns could therefore take place.

SUMMARY OF THE INVENTION

The invention is directed at overcoming this drawback.

For this purpose, the object of the invention is an ignition coil of the type described above, which is characterized by the fact that it comprises two high voltage terminals, the secondary winding being formed of two series half-windings, each wound on a secondary bobbin formed at one of its ends where the corresponding high voltage terminal is located, and the primary winding being housed within the two secondary bobbins which are arranged head to tail, with its two terminals passing between the open ends of the two secondary bobbins.

In one particular embodiment, the primary winding is wound in an even number of layers, starting from the center of the winding and extending towards one of the ends, and then from said end towards the other end, and then from said other end towards the center and possibly so on.

BRIEF DISCUSSION OF THE DRAWINGS

By way of non-limitative examples, a special embodiment of the invention will now be described referring to the accompanying drawings, in which.

DETAILED DESCRIPTION OF A PREFERRED EMBODIMENT

Figure 1:
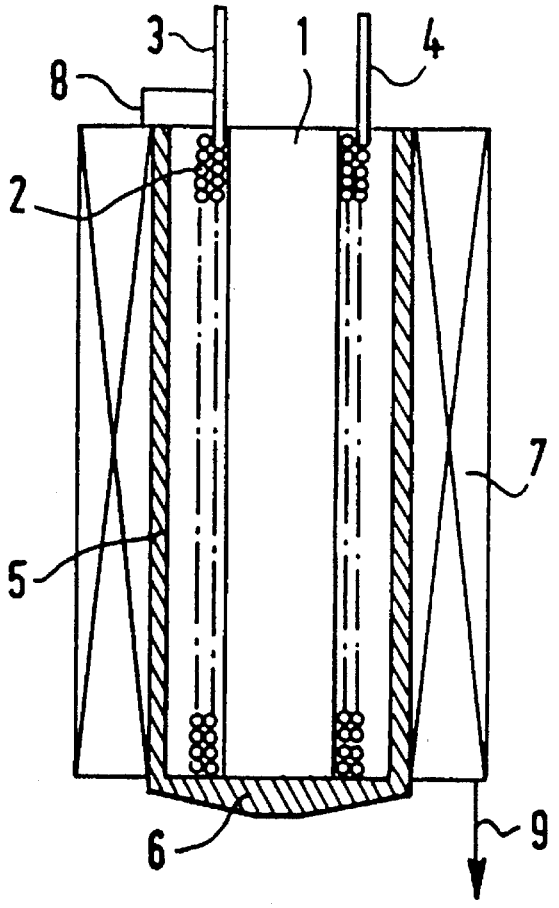
FIG. 1 PRIOR ART
FIG. 1 shows a single terminal coil of the prior art.

FIG. 1 shows the primary coil 1 in the form of a plastic tube in which the magnetic core is arranged (the part marked 1 could also be the magnetic core itself in the case of a primary winding wound directly on this core).

The primary winding 2 is wound on the primary bobbin 1, in this case in two layers. One of the ends 3 of the primary winding 2 is connected to ground while the other end 4 can be connected to low voltage via an electronic switch.

The assembly formed by the magnetic circuit, the bobbin 1, and the primary winding 2 is arranged within a secondary bobbin 5, the two ends 3 and 4 of the primary winding extending beyond said bobbin. This secondary bobbin is in the form of a tube having a bottom 6 at its end opposite the terminals 3 and 1 of the primary windings. The bobbin is made of a plastic material of high dielectric strength. The bobbin 6 can, for instance, be of the type having radial fins defining different annular winding compartments arranged axially side by side.

The secondary winding 7 is wound on the secondary bobbin 5 from one of its ends to the other. The end of the winding 7 located on the open side of the bobbin 5 is connected to ground by a connection 8, while its opposite end is connected by a high voltage connection 9 to the high voltage terminal, itself connected to the spark plug.

The assembly which has just been described is then arranged within a plastic housing (not shown) and is finally potted in an insulating resin cast in known manner in this housing.

Figure 2:
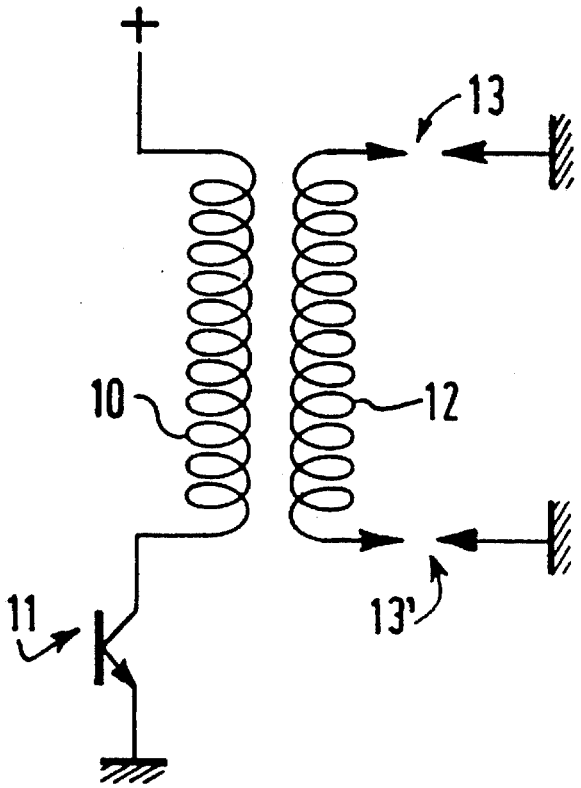
FIG. 2 is a diagram showing the principle of operation of double terminal coils.

FIG. 2 shows a basic diagram of a two-terminal coil.

The primary winding 10 of this coil has one of its ends connected to low voltage and its other end can be grounded via an electronic switch 11. The secondary winding 12 has each of its ends connected to a spark plug 13, 13'. The operation of such a coil has been indicated above.

Figure 3:
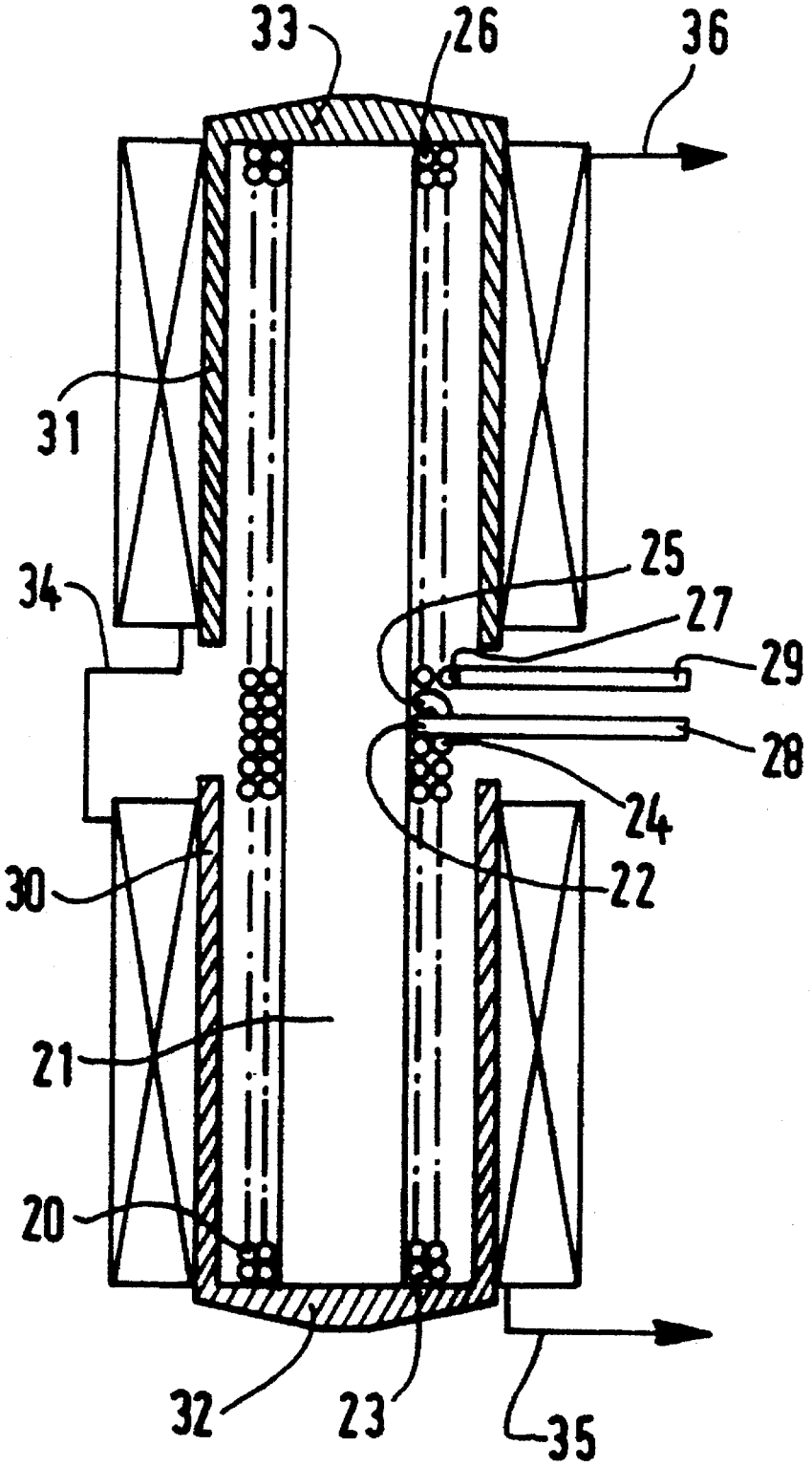
FIG. 3 shows a double terminal coil in accordance with the invention.

FIG. 3 shows such a coil in accordance with the invention.

The primary winding 20 is wound on a primary bobbin 21 in the form of a tube within which the magnetic coil is disposed (or directly on said magnetic core, as above).

The winding of the primary winding is started at 22 in the middle of the primary bobbin and then is continued over a first layer up to one of the ends of this primary bobbin at 23. The winding is then continued over a second layer up to the middle of the coil at 24, and then again over a first layer on the other half of the bobbin from 25 to 26 at the end of the bobbin opposite the end 23. Finally, the primary winding is terminated by a second layer from the end 26 up to 27 at the center of the bobbin. The two ends 28 and 29 of the primary winding are therefore in the center of the primary bobbin.

The assembly thus constituted is introduced into two secondary bobbins 30 and 31 on the side of the ends 23 and 26 respectively of the primary bobbin. The bobbins 30 and 31 are of the same type as the bobbin 5 of the embodiment of FIG. 1 and therefore have bottoms 32 and 33 respectively at the ends of the coil.

A first secondary half-winding is then wound on the secondary bobbin 30 from its closed end up to its open end, that is to say from the end of the coil up to its center. The secondary winding wire is then passed over the secondary bobbin 31, from its open side, via a connection 34. The secondary winding is then terminated around the bobbin 31 up to the closed end thereof, that is to say the end of the coil opposite the one where the secondary winding was started.

The two semi-secondaries can also be wound prior to mounting on the primary and connected electrically after mounting.

The two high voltage terminals 35 and 36 of the coil are therefore present at the two ends thereof where they are isolated from the primary winding by the bottoms 32 and 33 of the secondary bobbins 30 and 31 respectively.

No part of the secondary bobbin isolates the primary and secondary windings in the central part of the coil, but the risks of destructive breakdown are much less in this region since the voltage there is never brought to a value greater than half the value of the high voltage terminal.

I claim:

1. An ignition coil comprising:

a magnetic core;

two high voltage terminals; and primary and secondary windings wound around the magnetic core, said secondary winding being formed of two half-windings connected in series, each of said half-windings being wound on a tubular secondary bobbin, each of said secondary bobbins being closed at one of its ends where a respective one of said high voltage terminals is located, said secondary bobbins being arranged head-to-tail, said primary winding being housed within the two secondary bobbins with its two terminals passing between open ends of the secondary bobbins.

2. An ignition coil according to claim 1, in which the primary winding is wound on an even number of layers from the center of the winding towards one of the ends, then from said end towards the other end, and then from said other end towards the center.

* * * * *